United States Patent [19]

Jundt et al.

[11] 4,204,508

[45] May 27, 1980

[54] IGNITION SYSTEM FOR INTERNAL COMBUSTION ENGINE

[75] Inventors: Werner Jundt, Ludwigsburg; Bernd Bodig, Leinfelden; Herman Roozenbeek, Schwieberdingen; Peter Werner, Stuttgart, all of Fed. Rep. of Germany

[73] Assignee: Robert Bosch GmbH, Stuttgart, Fed. Rep. of Germany

[21] Appl. No.: 868,869

[22] Filed: Jan. 12, 1978

[30] Foreign Application Priority Data

Jan. 19, 1977 [DE] Fed. Rep. of Germany ..... 2701967

[51] Int. Cl.[2] ..... F02P 3/00

[52] U.S. Cl. ..... 123/148 E; 123/117 R

[58] Field of Search ..... 123/148 E, 117 R, 146.5 A; 315/209 T

[56] References Cited

U.S. PATENT DOCUMENTS

| | | | |
|---|---|---|---|
| 3,890,944 | 6/1975 | Werner et al. | 123/146.5 A X |
| 3,937,193 | 2/1976 | Kim | 123/148 E X |
| 4,095,576 | 6/1978 | Hattori et al. | 123/148 E |
| 4,128,091 | 12/1978 | Balan et al. | 123/148 E |

*Primary Examiner*—Tony Argenbright

*Attorney, Agent, or Firm*—Frishauf, Holtz, Goodman, & Woodward

[57] ABSTRACT

A transistor switch connected in series with the primary winding of the ignition coil permits and blocks current flow through the coil when in a conductive and non-conductive state respectively. Normally, the switch is "on" and "off" respectively in the presence and absence of an ignition current pulse furnished in synchronism with the rotation of the crankshaft of the engine. For increasing speeds, the time the switch is "on" prior to the ignition time is increased by switching it to the conductive state when the charge on a control capacitor reaches a predetermined charge. The charge on the control capacitor is changed in a first direction following receipt of each ignition signal. The rate of change of charge depends upon the resistance of the emitter-collector circuit of a first control transistor. The latter is, in turn, determined by the charge on an integrator capacitor which varies with changes in engine speed. When the charge on the control capacitor reaches a predetermined charge, the output transistor switch to the conductive state allowing current flow in the ignition coil.

18 Claims, 2 Drawing Figures

IGNITION SYSTEM FOR INTERNAL COMBUSTION ENGINE

Figure 1:
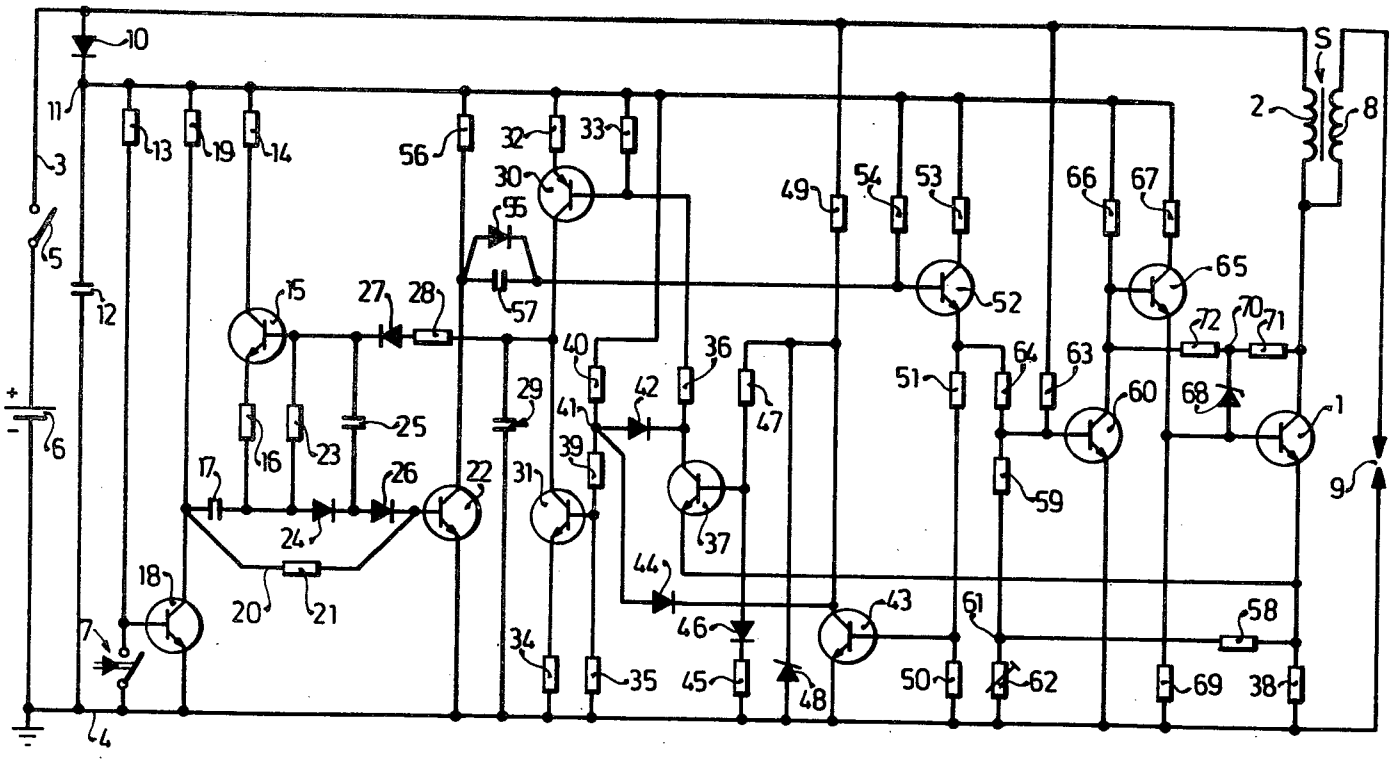

The present invention relates to ignition system, and particularly to systems for igniting the fuel-air mixture in an internal combustion engine. In these ignition systems a sequence of ignition control pulses is furnished by a pulse generator operating in synchronism with the crankshaft of the engine. A switch connected in series with the ignition coil is controlled to be in the conductive state and the non-conductive in the presence and absence of the pulses, respectively. When the series switch is in the conductive state, d-c current flows through the primary winding of the ignition coil. The interruption of the d-c current creates the spark in a spark plug connected to the secondary winding of the ignition coil.

BACKGROUND AND PRIOR ART

If the time that ignition current flows through the ignition coil is determined solely by the pulse width of the above-mentioned pulses, the time that current flows prior to ignition may be too short to allow it to reach the minimum value required for ignition during increasing engine speed. It has therefore been proposed (for example in DE-OS No. 1,539,178 to which U.S. Pat. No. 3,482,560 corresponds) that, under conditions of increasing engine speed, the time that the series switch is in the conductive state between successive ignition signals is increased, while the time it is in the non-conductive state is decreased. In this known system, the control is derived from an a-c generator furnishing a signal having a particular wave shape. However, the geometric shape of the rotor of this generator must be empirically derived and such a generator is, in general, difficult to manufacture. Further, as mentioned above, an a-c generator is required.

THE INVENTION

It is an object to allow the increase in the closure time of the series switch without utilizing an a-c generator as described above. Specifically, the system is to operate with an ignition signal generator having a standard rotor and furnishing, for example, a rectangular or substantially rectangular signal. The system is to operate in conjunction with a Hall generator or commercially available circuit breaker.

It is a further object of the present invention to cause the energy available for the spark to remain substantially constant throughout wide ranges of speed.

SUMMARY OF THE INVENTION

The present invention relates to an ignition system of an internal combustion engine having an ignition coil having a primary winding, and controllable switch means, for example a transistor, connected in series with said primary winding. The transistor has a conductive and a nonconductive state respectively allowing and blocking current flow in the primary winding. A source of d-c voltage is connected across the so-formed series circuit. Ignition signal furnishing means, for example a Hall generator, furnish an ignition signal switching said controllable switch means to said non-conductive state at the desired ignition time. The present invention is apparatus for decreasing the time the controlled switch means is in said non-conductive state and increasing the time said controlled switch means is in said conductive state between successive ignition times. It comprises a control capacitor and first circuit means, for example a first control transistor, for changing the charge on said control capacitor in a first detection upon receipt of said ignition signal. Integrator means, for example a capacitor, are furnished. The integrator means furnish an integrator signal which varies as a function of changes in speed of the internal combustion engine. Further, second circuit means, for example a resistor and diode, are furnished for connecting the integrator means to the first circuit means in such a manner that the rate of change of charge on said control capacitor varies as a function of said integrator signal. Finally, additional circuit means are provided which are connected between the control capacitor and said controllable switch means, for switching said controllable switch means to said conductive state when the charge on said control capacitor is a predetermined charge.

Drawings, illustrating an example:

FIG. 1 is a circuit diagram of a preferred embodiment of the present invention; and FIGS. *2a–2c* are timing diagrams indicating the variation of signal with respect to time at predetermined points in the circuit of FIG. 1.

The ignition control system shown in FIG. 1 is adapted for use in an internal combustion engine (not shown) which operates in a commercial vehicle (also not shown). In FIG. 1, an output transistor 1 has an emitter-collector circuit connected in series with the primary winding 2 of an ignition coil S. The so-formed series circuit is connected between a terminal 3 furnishing the supply voltage and a line 4 which is at ground potential. The terminal 3 is connected to one terminal of a switch 5 whose other terminal is connected to the positive pole of a battery 6. The negative pole of battery 6 is connected to ground potential. Ignition signal furnishing means, here indicated as a switch 7, cause the emitter-collecter circuit of transistor 1 to be switched to the conductive state thereby interrupting the current in the primary winding 2. The interruption of current in the primary winding 2 causes a high voltage to the generated in the secondary winding 8 of ignition coil S. This high voltage in turn initiates a spark at a spark plug 9. The anode of a diode 10 is connected to terminal 3, while its cathode is connected to a terminal 11. Diode 10 serves to protect the circuit from reverse voltages. A buffer capacitor 12 is connected between terminal 11 and ground potential. A resistor 13, connected in series with the breaker switch 7, is connected in parallel with capacitor 12. Also connected to terminal 11 is one terminal of a resistor 14 whose other terminal is connected to the emitter-collector circuit of a transistor 15. Transistor 15, the first control transistor, is an npn transistor. Its emitter is connected to a resistor 16 which in turn is connected to one terminal of a control capacitor 17 whose other terminal is connected to the collector of a transistor 18. The emitter-collector circuit of transistor 18 is connected from capacitor 17 to ground potential. The collector of transistor 18 is further connected through a resistor 19 to terminal 11. Transistor 18 is herein referred to as the second control transistor. A circuit branch 20 including a resistor 21 is connected to the collector of transistor 18. Resistor 21 is also connected to the base of a transistor 22 (third control transistor), which is an npn transistor. The terminal of control capacitor 17 which is not connected to transistor 15 is connected through a resistor 23 to the base of transistor 15. The anode of a blocking diode 24 is also connected to this terminal of capacitor 17. The cathode of diode 24 is connected to one terminal of an additional capacitor 25 whose other terminal is connected to base of transistor 15. The cathode of diode 24 is further connected to the anode of a diode 26 whose cathode is connected to the base of a third control transistor 22. Diode 26 serves to increase the threshold value of transistor 22. The base of first control transistor 15 is connected to the cathode of a blocking diode 27 whose anode is connected through a resistor 28 whose other terminal is connected through an integrator capacitor 29 to ground potential. The positive terminal of capacitor 29 is connected to the collector of a charging transistor 30 (pnp transistor) and to the collector of a discharge transistor 31 (npn transistor). The emitter of transistor 30 is connected through a resistor 32 to terminal 11, while its base is connected to terminal 11 through a resistor 33. Transistor 30 serves as a constant current source for integrating capacitor 29. The emitter of transistor 31 is connected to ground potential through a resistor 34, while its base is also connected to ground potential but through a resistor 35. The base of transistor 30 is further connected through a resistor 36 with the collector of a monitoring transistor 37 (npn transistor). The emitter of transistor 37 is connected through a monitoring resistor 38 to ground potential. The emitter of transistor 37 is further connected to the emitter of output transistor 1. The base of transistor 31 is connected to terminal 11 through a voltage divider including resistors 39 and 40. The common point of resistors 39 and 40 is connected to the anode of a blocking diode 42 whose cathode is connected to the collector of monitoring transistor 37. It is further connected through a diode 44 to the collector of a transistor 43 (npn transistor). The base of transistor 37 is connected through a diode 46 and a resistor 45 to ground potential. The base of transistor 37 is also connected through a resistor 47 to the cathode of a Zener diode 48, whose anode is connected to ground potential. The cathode of Zener diode 48 is connected through a resistor 49 to line 3. If is further connected to the collector of transistor 43. The emitter of transistor 43 is connected to ground potential, while its base is connected to ground potential through a resistor 50 and to the emitter of a transistor 52 through a resistor 51. The collector of transistor 52 is connected through a resistor 53 to terminal 11. The base of transistor 52 is connected through a resistor 54 to terminal 11 and through the parallel combination of a diode 55 and a capacitor 57 to the collector of transistor 22. The collector of transistor 22 is also connected through a resistor 56 to terminal 11. The emitter of output transistor 1 is connected through a resistor 58 and a resistor 59 to the base of a limiting transistor 60 (npn transistor). The emitter of transistor 60 is connected to ground potential. The common point of resistors 58 and 59 is connected through a variable resistor 62 to ground potential. The base of limiting transistor 60 is further connected to the supply voltage line 3 through a resistor 63 and to the emitter of a further transistor 52 through a resistor 64. The collector of limiting transistor 60 is connected to the base of a driving transistor 65 (npn transistor). The base of transistor 65 is further connected through a resistor 66 to terminal 11 and its collector is connected to terminal 11 through a resistor 67. The emitter of driving transistor 65 is connected to the base of output transistor 1. The base of output transistor 1 is connected to the anode of a Zener diode 68 and through a resistor 69 to ground potential. The cathode of Zener diode 68 is connected to the common point 70 of two resistors 71, 72 which are connected as a series circuit between the collector of transistor 1 and the collector of transistor 60.

OPERATION

Figure 2:
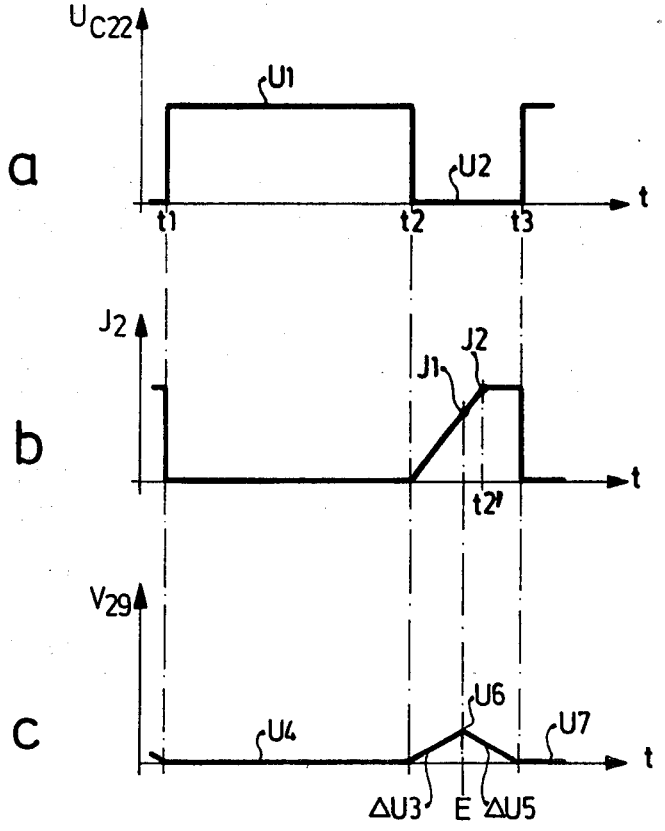

When main switch 5 is closed, the system is ready for operation. It will now be assumed that the engine is starting from rest, that is, that the engine speed is very low and, further, that switch 7 is in the closed state. Under these conditions, the emitter-collector circuit of transistor 1 is in the conductive state. Primary current therefore flows through primary winding 2 of the ignition coil. If the switch 7 is now opened, current starts to flow through elements 5, 10 and 13 to the base of the second control transistor 18, causing its emitter-collector circuit to become conductive. While the engine is starting up, the first control transistor 15 and the control capacitor 17 are inoperative, so that switching of transistor 18 causes the voltage at the base of transistor 22 to drop, thereby causing its emitter-collector circuit to be in the blocked state. The potential at the collector of transistor 12 then reaches the positive value U1 which is shown in FIG. 2*a*. Current now flows through the base-emitter circuit of transistor 52 and through the base-emitter circuit of limiting transistor 60 through elements 5, 10, 56, 55 and 64 causing the emitter-collector circuit of transistors 52 and 60 to switch to the conductive state. Under these conditions, no current can flow through the base-emitter circuit of transistors 65 and 1, causing the emitter-collector circuits of these transistors to switch to the blocked state. This causes an interruption of the current in primary winding 2, causing a high voltage to be generated in the secondary winding 8 and therefore a spark to be created at spark plug 9. While the engine is starting up, the flow of primary current will be reinitiated when switch 7 is again closed. The above-mentioned transistors then switch in the opposite direction, namely the emitter-collector circuit of second control transistor 18 is switched to the blocked state, the emitter-collector circuit of the third control transistor 22 into conductive state, the emitter-collector circuit of transistor 52 into the blocked state, the emitter-collector circuit of transistor 60 into the blocked state, the emitter-collector circuit of transistor 65 into the conductive state and, finally, the emitter-collector of transistor 1 is switched into the conductive state. The collector of transistor 22 is at the potential U2 which corresponds to ground potential and a current flows in primary winding 2, so that energy is stored for the next ignition process. Since the emitter-collector circuit of transistor 52 is in the blocked state, no current can flow through the emitter-base circuit of transistor 43, thereby causing the emitter-collector circuit of transistor 43 to switch to the blocked state. This allows current to flow over the base-emitter circuit of transistor 37 and elements 5, 49, 47 and 38. Therefore the emitter-collector circuit of monitoring transistor 37 becomes conductive, which allows current to flow over the emitter-base circuit of charging transistor 30 (via elements 5, 10, 32, 36 and 38). As a result, the emitter-collector circuit of transistor 30 becomes conductive, thereby starting the charging of integrator capacitor 29. As shown in FIG. 2*c*, capacitor 29 initially has a charge which causes a voltate U4 to appear at the terminal not connected to ground potential. A voltage change $\Delta U3$ results at this terminal as a result of the charging process.

The current in primary winding 2 is shown in FIG. 2b. When this current reaches the value I1, the potential drop across resistor 38 has increased to the extent that the emitter-collector circuit of transistor 37 is switched to the blocked state. Therefore the emitter-collector of transistor 30 also switches to the blocked state. This causes the end of the charging of capacitor 29 at a time when the potential at its high-voltage terminal is U6. When the emitter-collector circuit of transistor 37 switches to the blocked state, current can flow over the base-emitter circuit of discharge transistor 31 via elements 5, 10, 40, 39 and 34, causing the emitter-collector circuit of transistor 31 to become conductive thereby initiating the discharge of capacitor 29. The resulting voltage change ΔU5 at the high-voltage terminal of capacitor 29 is also shown in FIG. 2c. The discharge stops at the ignition time, since the emitter-collector circuits of transisor 52 and 43 then become conductive. Since the emitter-collector circuit of transistor 43 is conductive, the emitter-collector circuits of transistors 30, 31 and 37 become blocked. At the end of the discharge period, the voltage U7 exists at the high-voltage terminal of capacitor 29. The residual value after the discharge is the integrator signal which varies the conductivity of the emitter-collector circuit of transistor 15, thereby changing the charging rate of capacitor 17. The charging and discharging of capacitor 29 is controlled in such a manner that, when the speed of the engine is constant, the changes ΔU3 and ΔU5 are symmetrical with respect to a vertical line E, the change from the charging to the discharging process taking place when the current in the primary winding of the ignition coil reaches its monitored value I1. For increasing engine speeds, the integrator signal increases in the positive direction since the discharge time is somewhat shorter than the charging time, causing the voltage change ΔU5 to be less than the change ΔU3. As reference to FIG. 1 will show, increasing voltages across capacitor 29 cause an increase in conductivity of the emitter-collector circuit of transistor 15. Therefore, when switch 7 is opened at the ignition time during higher speeds and the emitter-collector circuit of transistor 18 is switched to the conductive state as a result thereof, a first change in charge takes place across control capacitor 17 due to current flow from line 3 through elements 10, 14, 15, 16 and 18. This causes the current through the base-emitter circuit of transistor 22 to be interrupted. The emitter-collector circuit of transistor 22 is therefore blocked which, as described above, causes the emitter-collector circuit of transistor 1 to be blocked, thereby initiating the ignition process. Even before switch 7 is again closed, thereby causing the emitter-collector circuit of transistor 18 to be in the blocked state, a predetermined value of charge across capacitor 17 is reached which corresponds to the threshold value of the third control transistor 22. This causes a current to flow over the base-emitter circuit of transistor 22 (through elements 5, 10, 14, 15, 16, 24 and 26) causing the emitter-collector circuit of transistor 22 to become conductive. This, as described above, causes transistor 1 to be switched to the conductive state so that current will flow in primary winding 2, causing ignition energy to be stored even before switch 7 is closed. Upon closure of switch 7, the emitter-collector circuit of transistor 18 is switched to the blocked state, causing a change in direction of current through capacitor 17, namely through elements 5, 10, 19, 24, 26 and 22. Capacitor 25 serves to supply additional current through the base-emitter circuit of transistor 15 upon switching of the charging direction of capacitor 17, causing the switching characteristic of the emitter-collector circuit of transistor 22 to be improved.

In case the main switch 5 and the breaker switch 7 are closed while the engine is not in operation, current can flow through elements 5, 10, 54, 57 and 22, causing capacitor 57 to become charged and a current to flow over the base-emitter circuit of transistor 52. This causes the emitter-collector circuit of transistor 52 and of transistor 60 to become conductive, causing the emitter-collector circuit of transistors 65 and 1 to be blocked. Any current flow through the primary winding 2 is therefore blocked.

Transistor 60 serves to limit the amplitude of the primary current to a predetermined value I2 which exceeds the above-mentioned value I1. The value I2 is the value required for proper ignition.

When the value I2 is reached, the voltage drop across resistor 38 as applied through resistors 58 and 59 causes transistor 60 to become slightly conductive. This limits the control current for transistors 65 and 1 and causes the current through the emitter-collector circuit of transistor 1 to be maitained at the desired value I2.

It is the function of Zener diode 68 to protect transistor 1 from over-voltages. These may occur, for example, upon termination of the current through the secondary winding 8 at the end of the ignition process.

Circuit elements 45, 46, 47 and 48 cause the operation of transistor 37 to be independent of temperature changes and changes in the supply voltage.

In the embodiment shown in FIG. 1, the potential changes ΔU3 and ΔU5 are obtaind using equal currents. Other embodiments are possible wherein one of the currents is higher than the other, but its time of flow is decreased.

It is further desirable to choose the value I2 to be such that, during the start-up of the engine, the current in the primary winding 2 remains at the value I2 over the time period indicated by t2'-t3 in FIG. 2b. Under these conditions, sufficient ignition energy will be stored in the primary winding 2 even when the time during which the current flows is decreased during the acceleration of the vehicle utilizing this ignition system.

In FIG. 1, the secondary winding 8 is shown as connected to a single spark plug 9 only. Of course, the winding 8 can be connected in turn to each of a plurality of spark plugs by use of a known distributor.

Further, the breaker switch 7 can be replaced by a Hall generator or an electro-optical pulse generator. Further, switch 7 may be used to signify the emitter-collector circuit of a transistor which forms part of a control stage connected to the ignition signal furnishing means.

Various changes and modifications may be made within the scope of the inventive concept.

We claim:

1. In an ignition system of an internal combustion engine having an ignition coil having a primary winding (2), controllable switch means having a conductive and a non-conductive state connected in series with said primary winding, a source of d-c voltage (6, 5) connected across the so-formed series circuit, and ignition signal furnishing means (7) for furnishing an ignition signal switching said controllable switch means to said non-conductive state at the desired ignition time, apparatus for decreasing the time said controllable switch means is in said non-conductive state and increasing the time said controllable switch means is in said conductive state between successive ignition times, comprising, in accordance with the invention, a control capacitor (17);

first circuit means (14, 15, 16, 18) connected to said control capacitor and said ignition signal furnishing means, for changing the charge on said control capacitor in a first direction upon receipt of said ignition signal;

integrator means (29) for furnishing an integrator signal varying as a function of changes in speed of said internal combustion engine;

second circuit means (27, 28) for connecting said integrator means to said first circuit means in such a manner that the rate of change of charge on said control capacitor varies as a function of said integrator signal; and additional circuit means connected between said control capacitor and said controllable switch means, for switching said controllable switch means to said conductive state when the charge on said control capacitor is a predetermined charge.

2. Apparatus as set forth in claim 1, wherein said first circuit means comprises a first control transistor (15) having an emitter-collector circuit connected to said control capacitor (17); and wherein said second circuit means (27, 28) comprise means for connecting said integrator means (29) to said control transistor in such a manner that the conductivity of said emitter-collector circuit varies as a function of said integrator signal.

3. Apparatus as set forth in claim 1, wherein said first circuit means comprises a second control transistor (18) having an emitter-collector circuit connected to said control capacitor, and means for connecting said second control transistor to said ignition signal furnishing means in such a manner that said second control transistor becomes conductive upon receipt of said ignition signal.

4. Apparatus as set forth in claim 2, wherein said additional circuit means comprise a third control transistor (22) adapted to switch to the conductive state when said charge on said control capacitor is said predetermined charge and connected to said controllable switch means in such a manner that the conductive and non-conductive state of said controllable switch means corresponds to the conductive and non-conductive state of said third control transistor respectively.

5. Apparatus as set forth in claim 2, wherein the second circuit means apply said integrator signal to the first control transistor (15) in a direction to change the conductivity of the emitter-collector circuit of said first control transistor to increase with increasing speed of said internal combustion engine.

6. Apparatus as set forth in claim 5, wherein said integrator signal increases with increasing speed of said internal combustion engine.

7. Apparatus as set forth in claim 6, wherein said integrator means comprises an integrator capacitor, charging means (30) commencing charging said integrator capacitor (29) when said third control transistor (22) switches to said conductive state, monitoring means (37) for furnishing a monitoring signal when the current through said primary winding of said ignition coil reaches a predetermined current, and discharge circuit means (31) for discharging said integrator capacitor upon receipt of said monitoring signal and terminating said discharge of said integrator capacitor when said third control transistor switches to the non-conductive state, the charge remaining on said integrator capacitor following termination of said discharge constituting said integrator signal.

8. Apparatus as set forth in claim 7, wherein a predetermined minimum amplitude of said current through said primary coil is required for ignition; and wherein said predetermined amplitude monitored by said monitoring means is less than said predetermined minimum value.

9. Apparatus as set forth in claim 7, wherein said integrator means further comprise means for stabilizing the current through said integrator capacitor during said charge and discharge thereof.

10. Apparatus as set forth in claim 9, wherein said charging means comprises the emitter-collector circuit of a charge transistor (30); and wherein said discharge means comprises the emitter-collector circuit of a discharge transistor (31).

11. Apparatus as set forth in claim 10, wherein said monitoring means comprises a monitoring transistor (37) connected to said charge and discharge transistors (30, 31) and controlling said charge transistor (30) to become non-conductive and said discharge transistor (31) to become conductive when said current through said primary winding reaches said predetermined value.

12. Apparatus as set forth in claim 11, wherein said monitoring means further comprises a monitoring resistor (38) connected in series with said controllable switch means.

13. Apparatus as set forth in claim 12, wherein said controllable switch means comprises the emitter-collector circuit of an output transistor.

14. Apparatus as set forth in claim 12, wherein said monitoring transistor has a base-emitter circuit, and wherein said base-emitter circuit is connected with said monitoring resistor.

15. Apparatus as set forth in claim 13, further comprising a limiting means (60) interconnected between said monitoring resistor and said output transistor, for limiting the current through said primary winding of said ignition coil to said predetermined minimum value required for ignition.

16. Apparatus as set forth in claim 2, wherein said first control transistor has a base; and wherein said second circuit means comprises means for connecting said integrator means to said base of said first control transistor.

17. Apparatus as set forth in claim 4, further comprising circuit means (21) interconnected between said ignition signal furnishing means and said third control transistor for switching said third control transistor to the non-conductive state in response to said ignition signal.

18. Apparatus as set forth in claim 2, further comprising a capacitor (25) connected in parallel with the base-emitter circuit of said first control transistor.

* * * * *